US010006292B2

(12) United States Patent
Kuwamura et al.

(10) Patent No.: US 10,006,292 B2
(45) Date of Patent: Jun. 26, 2018

(54) TURBINE

(71) Applicant: MITSUBISHI HITACHI POWER SYSTEMS, LTD., Kanagawa (JP)

(72) Inventors: Yoshihiro Kuwamura, Tokyo (JP); Kazuyuki Matsumoto, Tokyo (JP); Hiroharu Oyama, Tokyo (JP); Yoshinori Tanaka, Tokyo (JP); Hidekazu Uehara, Tokyo (JP); Yukinori Machida, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 480 days.

(21) Appl. No.: 14/358,453

(22) PCT Filed: Dec. 12, 2012

(86) PCT No.: PCT/JP2012/082206
§ 371 (c)(1),
(2) Date: May 15, 2014

(87) PCT Pub. No.: WO2013/089139
PCT Pub. Date: Jun. 20, 2013

(65) Prior Publication Data

US 2014/0314579 A1 Oct. 23, 2014

(30) Foreign Application Priority Data

Dec. 13, 2011 (JP) ..... 2011-272355

(51) Int. Cl.
*F01D 5/14* (2006.01)
*F01D 11/02* (2006.01)
(Continued)

(52) U.S. Cl.
CPC ..... *F01D 5/141* (2013.01); *F01D 5/225* (2013.01); *F01D 11/001* (2013.01); *F01D 11/02* (2013.01);
(Continued)

(58) Field of Classification Search
CPC . F01D 5/141; F01D 5/20; F01D 11/08; F01D 5/225; F01D 11/001; F01D 11/122; F01D 11/02
(Continued)

(56) References Cited

U.S. PATENT DOCUMENTS 4,643,645 A 2/1987 Robbins et al.
4,813,850 A 3/1989 Partington
(Continued)

FOREIGN PATENT DOCUMENTS

CN 1500187 5/2004
CN 101067384 11/2007
(Continued)

OTHER PUBLICATIONS

Chinese Office Action dated Feb. 3, 2015 in corresponding Chinese Patent Application No. 201280057231.5 with English translation.
(Continued)

*Primary Examiner* — Jason T Newton
(74) *Attorney, Agent, or Firm* — Wenderoth, Lind & Ponack, L.L.P.

(57) ABSTRACT

A turbine includes blades and a structure rotating relative to the blades and having a fluid flowing thereto. The turbine includes step portions that are provided in either radial tip portions of the blades or areas of the structure that face the radial tip portions; sealing fins that extend from the other of the radial tip portions of the blades or areas of the structure that face the radial tip portions toward the step portions, and form minute gaps between the sealing fins and the step
(Continued)

portions; a flow collision surface that is provided upstream of the sealing fins in a flow direction of the fluid and against which the fluid collides; a protrusion that protrudes toward an upstream side from the flow collision surface; and a facing surface that faces the flow collision surface.

7 Claims, 8 Drawing Sheets

(51) Int. Cl.
*F01D 11/00* (2006.01)
*F01D 11/12* (2006.01)
*F01D 5/22* (2006.01)
*F01D 11/08* (2006.01)

(52) U.S. Cl.
CPC ..... *F01D 11/08* (2013.01); *F01D 11/122* (2013.01); *F05D 2220/31* (2013.01)

(58) Field of Classification Search
USPC ..... 415/174.5, 230, 173.5, 173.1; 277/412, 277/418, 419
See application file for complete search history.

(56) References Cited

U.S. PATENT DOCUMENTS

| | | | | |
|---|---|---|---|---|
| 6,547,522 | B2 | 4/2003 | Turnquist et al. | |
| 2007/0258826 | A1 | 11/2007 | Bracken et al. | |
| 2008/0056895 | A1 | 3/2008 | Senoo | |
| 2010/0164179 | A1 | 7/2010 | Hirakawa et al. | |
| 2011/0309585 | A1 | 12/2011 | Uehara et al. | |
| 2012/0121393 | A1* | 5/2012 | Kuwamura | F01D 5/225 415/173.1 |
| 2013/0094945 | A1* | 4/2013 | Kuwamura | F01D 11/02 415/173.1 |
| 2014/0119901 | A1* | 5/2014 | Shibata | F01D 11/08 415/173.1 |
| 2016/0130965 | A1* | 5/2016 | Yamaguchi | F01D 1/04 415/13 |

FOREIGN PATENT DOCUMENTS

| | | | | |
|---|---|---|---|---|
| CN | 1800589 | | 6/2010 | |
| EP | 2 372 103 | | 10/2011 | |
| JP | 02-30903 | | 2/1990 | |
| JP | 11200810 | A * | 7/1999 | F01D 11/02 |
| JP | 2002228014 | A * | 8/2002 | F01D 11/02 |
| JP | 2004-332616 | | 11/2004 | |
| JP | 2006-291967 | | 10/2006 | |
| JP | 2007-298040 | | 11/2007 | |
| JP | 2008-75510 | | 4/2008 | |
| JP | 2011-12631 | | 1/2011 | |
| JP | 2011-080452 | | 4/2011 | |
| JP | 2011-208602 | | 10/2011 | |
| JP | 2012-072689 | | 4/2012 | |
| WO | 2008/056454 | | 5/2008 | |
| WO | 2010/146797 | | 12/2010 | |
| WO | WO 2011/043286 | A1 * | 4/2011 | F01D 11/08 |
| WO | 2011/122092 | | 10/2011 | |

OTHER PUBLICATIONS

International Search Report dated Mar. 19, 2013 in International (PCT) Application No. PCT/JP2012/082206 with English translation.
Written Opinion of the International Searching Authority dated Mar. 19, 2013 in International (PCT) Application No. PCT/JP2012/082206 with English translation.
Extended European Search Report dated Jun. 23, 2015 in corresponding European Application No. 12857899.4.

* cited by examiner

TURBINE

TECHNICAL FIELD

The present invention relates to a turbine used for, for example, power generation plants, chemical processing plants, gas plants, iron mills, vessels, or the like.

Priority is claimed from Japanese Patent Application No. 2011-272355, filed Dec. 13, 2011, the contents of which are incorporated herein by reference.

BACKGROUND ART

In the related art, a steam turbine having a casing through which steam flows, and a shaft body rotatably provided inside this casing has been known as a type of a steam turbine. In this steam turbine, stator blades are fixed to an inner peripheral surface of the casing, rotor blades are fixed to an outer peripheral surface of the shaft body, and a plurality of stages of stator blades and rotor blades are alternately provided in axial direction.

This steam turbine is roughly classified into an impulse turbine and a reaction turbine depending on a difference in operation type. In the impulse turbine, the rotor blades are rotated only by an impulse force received from steam. In the impulse turbine, the stator blades have a nozzle shape, the steam passing through the stator blades are jetted to the rotor blades, and the rotor blades are rotated only by the impulse force received from the steam. Meanwhile, in the reaction turbine, the shape of the stator blades are the same as that of the rotor blades, and the rotor blades are rotated by an impulse force received from the steam passing through the stator blades, and by a reaction force against the expansion of the steam generated when passing by the rotor blades.

Incidentally, in such a steam turbine, gaps with a predetermined width are formed in a radial direction between tip portions of the rotor blades and the casing, and gaps with a predetermined width are also formed in the radial direction between tip portions of the stator blades and the shaft body. A portion of the steam that flows in an axis direction of the shaft body leaks to a downstream side through the gaps of the tip portions of the rotor blades or stator blades. Here, since the steam leaked to the downstream side from the gaps between the rotor blades and the casing does not give an impulse force or a reaction force to the rotor blades, the steam hardly contributes as a driving force that rotates the rotor blades irrespective of either the impulse turbine or the reaction turbine. Additionally, since the steam leaked to the downstream side from the gaps between the stator blades and the shaft body does not change in speed and does not expand even if the steam flows over the stator blades, the steam hardly contributes as a driving force that rotates the stator blades on the downstream side irrespective of either the impulse turbine or the reaction turbine. Accordingly, in order to improve the performance of the steam turbine, it is important to reduce the amount of leaking of the steam in the gaps of the tip portions of the rotor blades or the stator blades.

Thus, sealing fins are used as means for preventing the steam from leaking from the gaps of the tip portions of the rotor blades or the stator blades. When the sealing fins are used for, for example, the tip portions of the rotor blades, the sealing fins protrude from either the rotor blades or the casing, and are provided so as to form minute gaps between the sealing fins and the other of the rotor blades or the casing.

Incidentally, as the rotor blades, there are known rotor blades, each having a protrusion that protrudes toward the upstream side, and being provided on an upstream surface of a shroud that constitutes the tip portion of the rotor blade, that is, a surface against which a steam current collides (refer to Japanese Unexamined Patent Application Publication No. 2006-291967 and Japanese Unexamined Patent Application Publication No. 02-030903).

However, these Japanese Unexamined Patent Application Publication No. 2006-291967 and Japanese Unexamined Patent Application Publication No. 02-030903 do not describe the significance of providing this protrusion on the shroud.

Technical Problem

However, in the related-art steam turbine in which the sealing fins are provided at the tip portions of the rotor blades or the stator blades, when the sealing fins protrude from the rotor blades or stator blade side, there is a problem in that the sealing performance of preventing the leaking of the steam to the downstream side is not satisfactorily obtained.

FIG. 8 is a schematic cross-sectional view showing the periphery of a tip portion of a rotor blade 80 in the related-art steam turbine.

When sealing fins 82 protrude from a shroud 81 that constitutes the rotor blade 80, steam S that has collided against the rotor blade 80 forms a main vortex SU inside a cavity C formed on the upstream side of the rotor blade 80. As a portion of the main vortex SU collides against a corner portion 83 of the shroud 81 and is separated therefrom, a separation vortex HU is formed. However, the separation vortex HU flows from a casing 84 toward the sealing fins 82 side in tip portions of the sealing fins 82.

Accordingly, the separation vortex HU has a weak contraction flow effect, that is, a weak effect of compressing the steam S leaked to the downstream side through minute gaps 85 between tips of the sealing fins 82 and the casing 84, in the radial direction to reduce the amount of leaking. Accordingly, in the configuration in which the sealing fins 82 protrude from the rotor blade 80, sealing performance is not satisfactorily obtained.

SUMMARY OF THE INVENTION

The invention has been made in consideration of such circumstances, and an object of the invention is to provide means for reducing the amount of leaking of steam in gaps between the tip of sealing fins and blades or a structure, in a turbine in which the sealing fins extend from either the blade or the structure toward the other.

Solution to Problem (1) A turbine according to the invention is a turbine including a blade and a structure provided on a radial tip end side of the blade via a gap and rotating relative to the blade, and having a fluid flowing to the gap. The turbine includes a step portion that is provided in either a radial tip portion of the blade or an area of the structure that faces the radial tip portion, and has a step in a radial direction; a sealing fin that extends from the other of the radial tip portion of the blade and the area of the structure that faces the radial tip portion, toward the step portion, and forms a minute gap between the sealing fin and the step portion; a flow collision surface that is provided upstream of the sealing fin in a flow direction of the fluid, and against which the fluid collides; a protrusion that protrudes toward an upstream side from the flow collision surface; and a facing surface that faces the flow collision surface.

According to such a configuration, the fluid that collides against the flow collision surface forms a main vortex in a space located further toward the blade base end side than the protrusion, between the flow collision surface and the facing surface. As a portion of the main vortex is separated from the protrusion, a separation vortex is generated in a space located further toward a blade tip end side than the protrusion between the flow collision surface and the facing surface. Moreover, as a portion of the separation vortex is further separated from a corner portion of the step portion, a separation vortex is generated inside a widened portion formed on the upstream side of the sealing fin. The separation vortex generated in the widened portion flows from the sealing fin toward the structure side, at the position of the minute gap formed between the tip of the sealing fin and the structure.

Accordingly, this separation vortex exhibits a so-called contraction flow effect of reducing the amount of leaking of the fluid in the minute gap.

(2) It is preferable that a free-cutting material having more excellent machinability than the sealing fin be provided on the surface of the step portion.

According to such a configuration, the thermal elongation caused in the blade at the time of the starting of the turbine becomes larger than the thermal elongation caused in the structure, and centrifugal elongation is caused when the blade is a rotor blade, whereby the sealing fin cuts the free-cutting material. Thereafter, the turbine shifts to a rated operation, and the thermal elongation of the blade becomes equal to the thermal elongation of the structure or less than the thermal elongation of the structure, whereby the sealing fin is brought into a state where the sealing fin is separated from free-cutting material. At this time, the radial width between the sealing fin and the free-cutting material becomes narrower than the radial width between the sealing fin and the step portion in a case where there is no free-cutting material.

This can reduce the amount of leaking of the fluid in the tip portion of the sealing fin.

(3) It is preferable that the step portion be provided at the structure, and the sealing fin be provided at the blade.

According to such a configuration, since the tip portion of the sealing fin is located a position separated from the blade, the heat caused by the sliding between the tip portion of the sealing fin and the structure is not easily transferred to the blade.

(4) It is preferable that the structure be a casing that holds a shaft body that is rotationally driven, and the blade be a rotor blade that is fixed to the shaft body and extends to the casing side.

According to such a configuration, the amount of leaking of the fluid from the minute gap formed between the sealing fin and the casing can be suppressed to the minimum in the tip portion of the rotor blade.

(5) It is preferable that the structure be a shaft body that is rotationally driven, and the blade be a stator blade that is fixed to the casing holding the shaft body and extends to the shaft body side.

According to such a configuration, the amount of leaking of the fluid from the minute gap formed between the sealing fin and the shaft body can be suppressed to the minimum in the tip portion of the stator blade.

Advantageous Effects of Invention

According to the turbine according to the invention, in the turbine in which the sealing fin extends from either the blade or the structure toward the other, the amount of leaking of the steam in the gap between the tip of the sealing fin and the blade or the structure can be reduced.

DESCRIPTION OF EMBODIMENTS

First Embodiment

Figure 1:
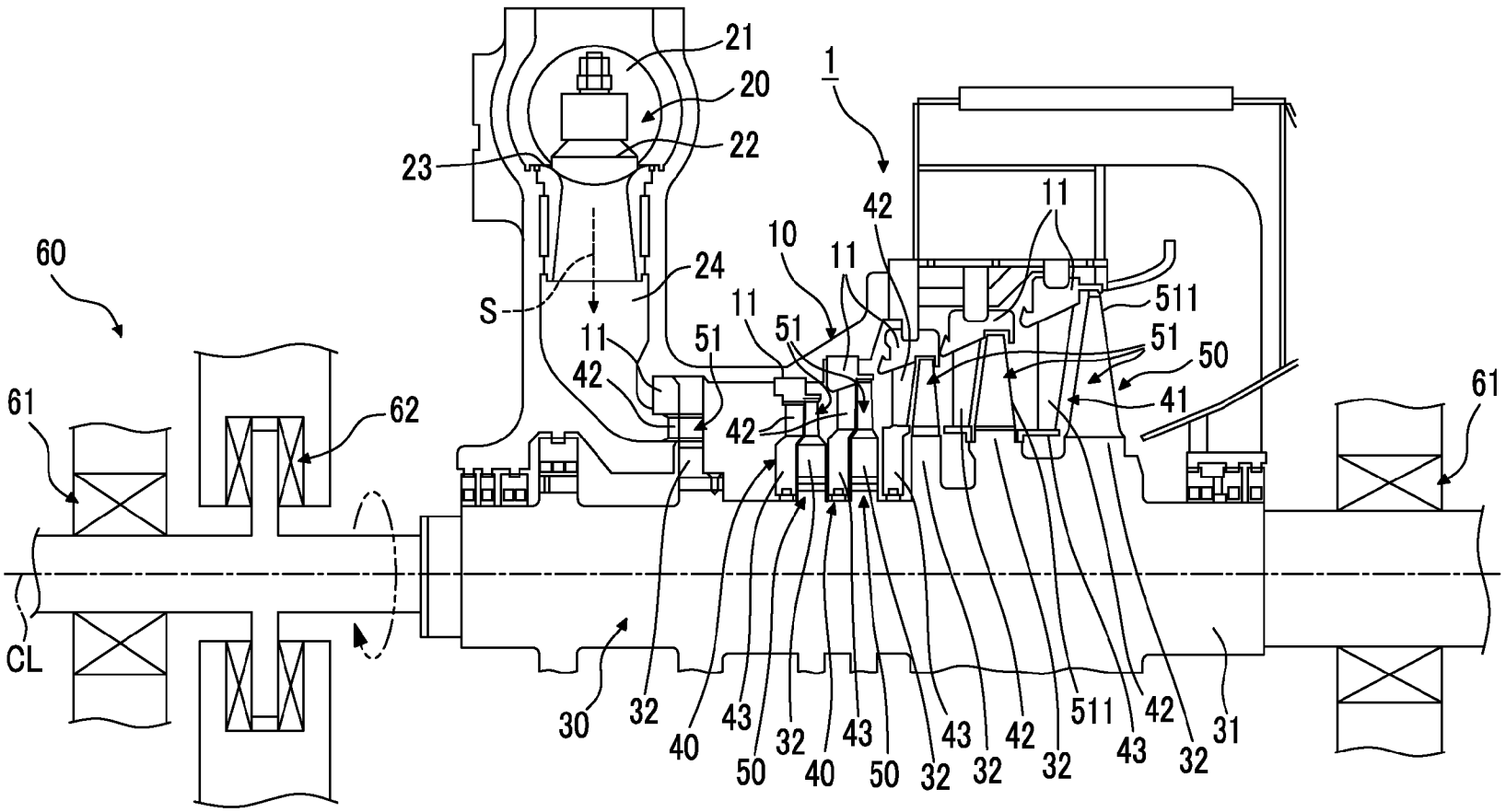
FIG. 1 is a schematic cross-sectional view showing a steam turbine related to a first embodiment of the invention.

Hereinafter, embodiments of the invention will be described with reference to the drawings. First, the configuration of a steam turbine related to a first embodiment of the invention will be described. FIG. 1 is a schematic cross-sectional view showing the steam turbine related to the first embodiment of the invention.

A steam turbine 1 includes a hollow casing 10, an adjusting valve 20 that adjusts the amount and pressure of steam S (fluid) that flows into the casing 10, a shaft body 30 that is rotatably provided inside the casing 10 to transmit power to machines, such as a generator (not shown), an annular stator blade group 40 held by the casing 10, an annular rotor blade group 50 (blades) provided at the shaft body 30, and a bearing section 60 that rotatably supports the shaft body 30 around an axis CL.

The casing 10 has an internal space airtightly sealed, and serves as a flow channel for the steam S. The casing 10 has a ring-shaped partition plate outer ring 11 (structure) fixed to an inner wall surface thereof. The shaft body 30 is inserted through the partition plate outer ring 11.

A plurality of the adjusting valves 20 are attached to the inside of the casing 10, and each adjusting valve includes an adjusting valve chamber 21 into which the steam S flows from a boiler (not shown), a valve body 22, and a valve seat 23. If the valve body 22 is separated from the valve seat 23, a steam flow channel is opened, and the steam S flow into the internal space of the casing 10 via a steam chamber 24.

The shaft body 30 includes a main shaft body 31 and a plurality of disks 32 extending in a radial direction from an outer periphery of the main shaft body 31. The shaft body 30 transmits rotational energy to machines, such as the generator (not shown).

The annular stator blade group 40 is formed by a plurality of stator blades 41 being provided on an inside surface of the casing 10 along a circumferential direction of the shaft body 30. Each stator blade 41 has a blade body 42 that has a base end portion held by the partition plate outer ring 11, and a ring-shaped hub shroud 43 that connects radial tip portions of the blade bodies 42 in the circumferential direction. The shaft body 30 is inserted through the hub shroud 43 via a gap with a predetermined width in the radial direction.

Six annular stator blade groups 40 configured in this way are provided at predetermined intervals in the axial direction of the shaft body 30, and convert the pressure energy of the steam S into speed energy so as to be guided to rotor blade 51 sides adjacent to downstream sides.

The bearing section 60 has a journal bearing device 61 that receives the shaft body 30 in the radial direction, and a thrust bearing device 62 that receives the shaft body 30 in the axial direction, and rotatably supports the shaft body 30.

The annular rotor blade group 50 is formed by a plurality of rotor blades 51 being provided along the circumferential direction of the shaft body 30. Each rotor blade 51 has a blade body 511 that has a base end portion fixed to the disk 32, and a ring-shaped tip shroud 512 (not shown in FIG. 1) that connects radial tip portions of the blade bodies 511 in the circumferential direction. Six annular rotor blade groups 50 configured in this way are provided so as to be adjacent to the downstream sides of the six annular stator blade groups 40, respectively.

Accordingly, a total of six stages, each of which is formed by a set of the annular stator blade group 40 and the annular rotor blade group 50, are configured along the axial direction.

Figure 2:
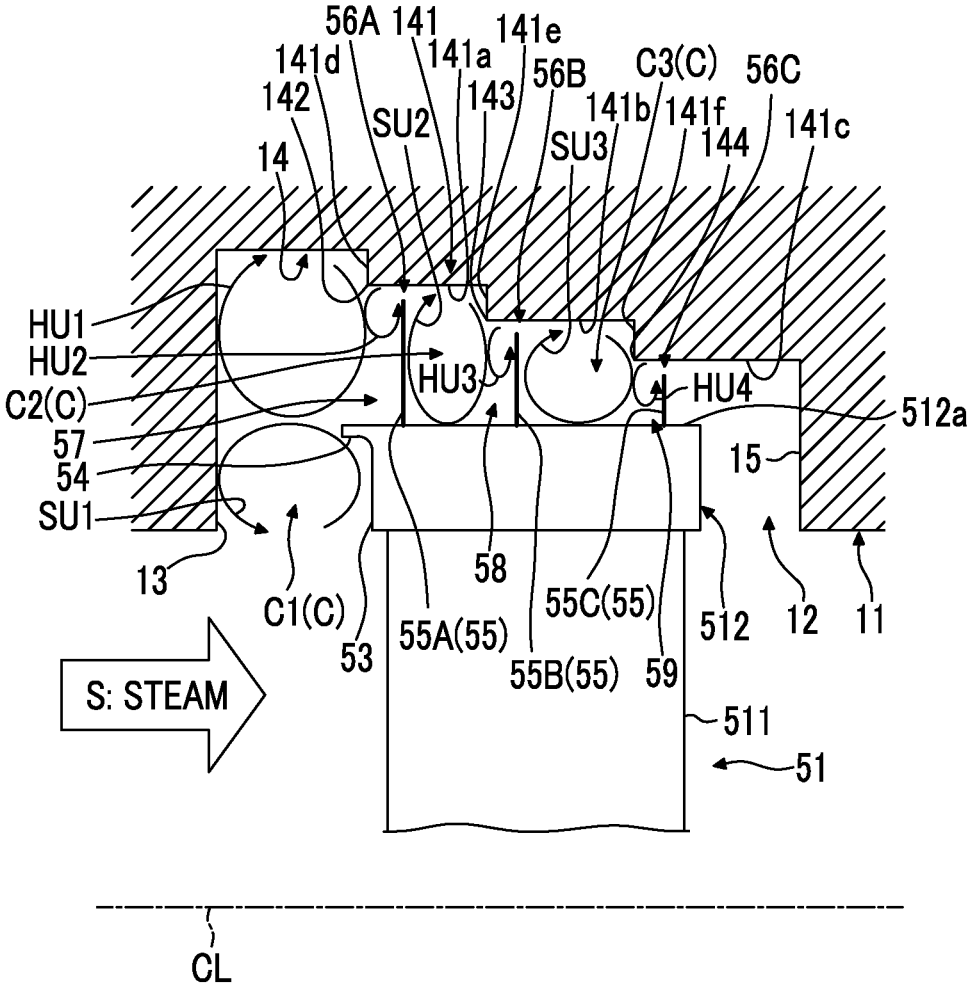
FIG. 2 is a partially enlarged cross-sectional view showing the periphery of a tip portion of a rotor blade in FIG. 1.

Here, FIG. 2 is a partially enlarged cross-sectional view that enlarged the periphery of a tip portion of a rotor blade 51 in FIG. 1.

An annular groove 12 is formed along the circumferential direction in an inner peripheral surface of the partition plate outer ring 11 shown in FIG. 2. The annular groove 12 is formed by an upstream wall surface 13 (facing surface), a bottom surface 14, and a downstream wall surface 15. A stair-shaped step portion 141 is provided at the position of the bottom surface 14 that faces the tip shroud 512. The step portion 141 includes three steps that protrude to the rotor blade 51 side as it goes to the downstream side, and has three axial wall surfaces (inner peripheral surfaces) 141*a*, 141*b*, and 141*c* along the axial direction, and three radial wall surfaces 141*d*, 141*e*, and 141*f* along the radial direction.

In addition, so long as the step portion 141 has at least the axial wall surface 141*a* and the radial wall surface 141*d*, the number of steps thereof is not limited to the three stages, and can be arbitrarily changed.

Meanwhile, as shown in FIG. 2, the ring-shaped tip shroud 512 is disposed at the tip portion of the rotor blade 51 as mentioned above. The tip shroud 512 has a substantially rectangular cross-section, and a steam collision surface 53 (flow collision surface) on which the steam S collides is provided at the position that faces the upstream wall surface 13 of the partition plate outer ring 11. A radial tip portion of the steam collision surface 53 is provided with a protrusion 54 that protrudes toward the upstream side. The protrusion 54 has a substantially rectangular cross-section, and is provided at the radial tip portion of the tip shroud 512.

In addition, the cross-sectional shape of the protrusion 54 is not limited to the rectangular shape of the present embodiment, and the protrusion can be arbitrarily changed in design, for example, can also be a triangular shape or a semicircular shape.

Additionally, the cross-sectional shape of the tip shroud 512 is not limited to the present embodiment, for example, the cross-sectional shape may be a stair shape of which the thickness in the radial direction becomes smaller as it goes to the downstream side.

Additionally, the position where the protrusion 54 is formed is not limited to the radial tip portion in the steam collision surface 53 of the tip shroud 512, for example, the position may be a radial middle portion or a radial base end portion.

Additionally, the protrusion 54 may be constituted as a so-called axial sealing fin by making a tip of the protrusion 54 protrude to a position close to the upstream wall surface 13 so as to form a minute gap between the protrusion 54 and the upstream wall surface 13.

As shown in FIG. 2, three sealing fins 55 are provided at predetermined intervals in the axial direction on an outer peripheral surface 512*a* of the tip shroud 512 so as to protrude in the radial direction, respectively. Among these fins, a first sealing fin 55A located furthest toward the upstream side has a base end portion fixed to a position slightly downstream of the radial wall surface 141*d*, and reaches a position where a tip portion thereof approaches the axial wall surface 141*a* of the step portion 141.

Accordingly, a minute gap 56A is formed between the first sealing fin 55A and the axial wall surface 141*a*.

Additionally, a second sealing fin 55B located secondly further toward the upstream side has a base end portion fixed to a position slightly downstream of the radial wall surface 141*e*, and reaches a position where a tip portion thereof approaches the axial wall surface 141*b* of the step portion 141.

Accordingly, a minute gap 56B is formed between the second sealing fin 55B and the axial wall surface 141*b*.

Additionally, a third sealing fin 55C located furthest toward the downstream side has a base end portion fixed to a position slightly downstream of the radial wall surface 141*f*, and reaches a position where a tip portion thereof approaches the axial wall surface 141*c* of the step portion 141.

Accordingly, a minute gap 56C is formed between the third sealing fin 55C and the axial wall surface 141*c*.

The lengths of the sealing fins 55 configured in this way become gradually shorter in order of the first sealing fin 55A, the second sealing fin 55B, and the third sealing fin 55C.

In addition, the lengths, shapes, installation positions, number, or the like of the sealing fins 55 is not limited to the present embodiment, and design can be appropriately changed according to the cross-sectional shape or the like of the tip shroud 512 and/or the partition plate outer ring 11.

Additionally, it is suitable to set the dimensions of the minute gaps 56A, 56B, and 56C to minimum values within safe ranges where the sealing fins 55 and the partition plate outer ring 11 do not contact each other, after the thermal elongation of the casing 10 or the rotor blade 51, the centrifugal elongation of the rotor blade, or the like are taken into consideration.

In the present embodiment, the three minute gaps 56A, 56B, and 56C are all set to the same dimension. However, the minute gaps 56A, 56B, and 56C may be different to the different dimensions for the respective sealing fins 55 if necessary.

According to the configuration around the tip portion of such a rotor blade 51, as shown in FIG. 2, three cavities C are formed by the partition plate outer ring 11, the three sealing fins 55, and the tip shroud 512.

Among these cavities, a first cavity C1 located furthest to the upstream side is formed by the upstream wall surface 13 of the partition plate outer ring 11, similarly the bottom surface 14 of the partition plate outer ring 11, the first sealing fin 55A, and the steam collision surface 53 of the tip shroud 512.

Additionally, a second cavity C2 located secondly further to the upstream side is formed by the first sealing fin 55A, the bottom surface 14 of the partition plate outer ring 11, the second sealing fin 55B, and the outer peripheral surface 512*a* of the tip shroud 512.

Additionally, a third cavity C3 located furthest to the downstream side is formed by the second sealing fin 55B, the bottom surface 14 of the partition plate outer ring 11, the third sealing fin 55C, and the outer peripheral surface 512*a* of the tip shroud 512.

Here, as shown in FIG. 2, the first cavity C1 has a substantially rectangular shape in a cross-section taken along the axial direction. However, the first sealing fin 55A is fixed to a position slightly downstream of the radial wall surface 141*d* as mentioned above. Accordingly, a widened portion 57 that is slightly widened in the axial direction is formed at an axial downstream portion of the first cavity C1.

Additionally, as shown in FIG. 2, the second cavity C2 has a substantially rectangular shape in a cross-section taken along the axial direction. However, the second sealing fin 55B is fixed to a position slightly downstream of the radial wall surface 141*e* as mentioned above. Accordingly, a widened portion 58 that is slightly widened in the axial direction is formed also at an axial downstream portion of the second cavity C2.

Moreover, the third cavity C3 also has a substantially rectangular shape in a cross-section taken along the axial direction. However, the third sealing fin 55C is fixed to a position slightly downstream of the radial wall surface 141*f* as mentioned above. Accordingly, a widened portion 59 that is slightly widened in the axial direction is formed also at an axial downstream portion of the third cavity C3.

Next, the functional effects of the steam turbine 1 related to the first embodiment will be described with reference to FIGS. 1 and 2.

If the adjusting valve 20 shown in FIG. 1 is brought into an open state, steam S flow into the casing 10 from the boiler (not shown). This steam S is guided to the annular rotor blade group 50 by the annular stator blade group 40 of each stage, and the annular rotor blade group 50 starts to rotate. Accordingly, the energy of the steam S is converted into rotational energy by the annular rotor blade group 50, and this rotational energy is transmitted to the generator (not shown) or the like from the shaft body 30 that rotates integrally with the annular rotor blade group 50.

At this time, a portion of the steam S that has passed through the annular stator blade group 40 does not contribute to the rotation of the annular rotor blade group 50, and leaks to the downstream side through the minute gaps 56A, 56B, and 56C between three sealing fins 55 shown in FIG. 2 and the partition plate outer ring 11.

The leaking of the steam S will be described in detail.

As shown in FIG. 2, a portion of the steam S, which passes through the annular stator blade group 40 and flows in the axial direction, collides against the steam collision surface 53 of the tip shroud 512. Then, for example, a counterclockwise main vortex SU1 in FIG. 2 is generated in a region located further toward a blade base end side than the protrusion 54 inside the first cavity C1.

As a portion of the main vortex SU1 is separated from the protrusion 54, a separation vortex HU1 is generated in a region located further toward a blade tip end side than the protrusion 54 inside the first cavity C1. The rotational direction of the separation vortex HU1 is a direction reverse to that of the main vortex SU1, that is, a clockwise direction in FIG. 2.

As a portion of the separation vortex HU1 is further separated from a corner portion 142 of the step portion 141, a separation vortex HU2 is generated in the widened portion 57 of the first cavity C1. The rotational direction of the separation vortex HU2 is a direction reverse to that of the separation vortex HU1, that is, a counterclockwise direction in FIG. 2. The separation vortex HU2 exhibits a so-called contraction flow effect of reducing the amount of leaking of the steam S in the minute gap 56A between the first sealing fin 55A and the partition plate outer ring 11.

Figure 3:
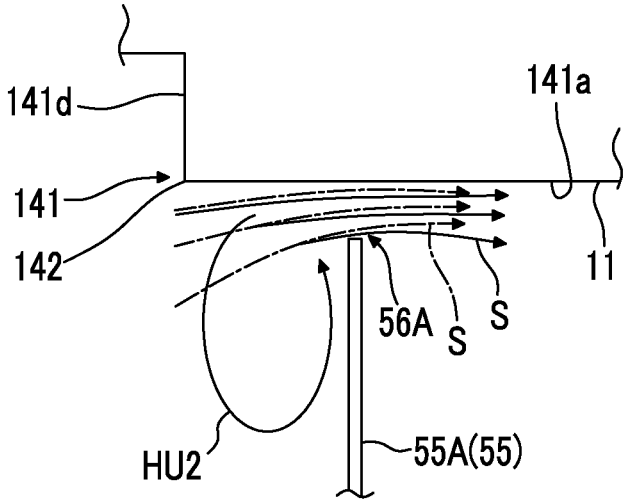
FIG. 3 is a partially enlarged cross-sectional view illustrating a contraction flow effect of a separation vortex, and showing the periphery of a tip portion of a first sealing fin in FIG. 2.

FIG. 3 is a partially enlarged cross-sectional view illustrating the contraction flow effect of the separation vortex HU2, and showing the periphery of the tip portion of the first sealing fin 55A in FIG. 2.

The counterclockwise separation vortex HU2 flows from the first sealing fin 55A toward the partition plate outer ring 11 side at the position of the minute gap 56A. Accordingly, the separation vortex HU2 has a radially outward inertia force. Accordingly, the steam S that leaks to the downstream side through the minute gap 56A is pressed to an axial wall surface 141*a* side with the inertia force of the separation vortex HU2, whereby the width of the steam in the radial direction is reduced as shown by a one-dot chain line in FIG. 3.

In this way, the separation vortex HU2 has the effect of reducing the amount of leaking, that is, the contraction flow effect, by compressing the steam S in the radial direction. Additionally, this contraction flow effect becomes greater as the inertia force of the separation vortex HU2 is larger, that is, as the flow velocity of the separation vortex HU2 is faster.

Then, as shown in FIG. 2, the steam S that has leaked from the minute gap 56A flows into the second cavity C2. The steam S collides against the radial wall surface 141*e* of the partition plate outer ring 11 to form a clockwise main vortex SU2. As a portion of the main vortex SU2 is separated from a corner portion 143 of the step portion 141, a counterclockwise separation vortex HU3 is generated in the widened portion 58 of the second cavity C2. The separation vortex HU3 flows from the second sealing fin 55B toward the partition plate outer ring 11 side at the position of the minute gap 56B.

Accordingly, the separation vortex HU3 also exhibits the contraction flow effect of reducing the amount of leaking of the steam S in the minute gap 56B, similar to the separation vortex HU2.

Moreover, the steam S that has leaked from the minute gap 56B flows into the third cavity C3. The steam S collides against the radial wall surface 141*f* of the partition plate outer ring 11 to form a clockwise main vortex SU3. As a portion of the main vortex SU3 is separated from a corner portion 144 of the step portion 141, a counterclockwise separation vortex HU4 is generated in the widened portion 59 of the third cavity C3. The separation vortex HU4 flows from the third sealing fin 55C toward the partition plate outer ring 11 side at the position of the minute gap 56C.

Accordingly, the separation vortex HU4 also exhibits the contraction flow effect of reducing the amount of leaking of the steam S in the minute gap 56C, similar to the separation vortex HU2.

In this way, the amount of leaking of the steam S can be suppressed to the minimum by reducing the amounts of leaking of the steam S in the first cavity C1, the second cavity C2, and the third cavity C3, respectively, by the contraction flow effect of the separation vortex HU2, the separation vortex HU3, and the separation vortex HU4. In addition, the number of the cavities C along the axial direction is not limited to three, and an arbitrary number of cavities can be provided.

Second Embodiment

Next, the configuration of a steam turbine related to a second embodiment of the invention will be described. The steam turbine related to the second embodiment is different from the steam turbine 1 of the first embodiment only in the configuration of the partition plate outer ring 11 fixed to the inner wall surface of the casing 10 shown in FIG. 1. Since the other configuration is the same as that of the first embodiment, the same configuration will be designated by the same reference numerals, and the description thereof will be omitted here.

Figure 4:
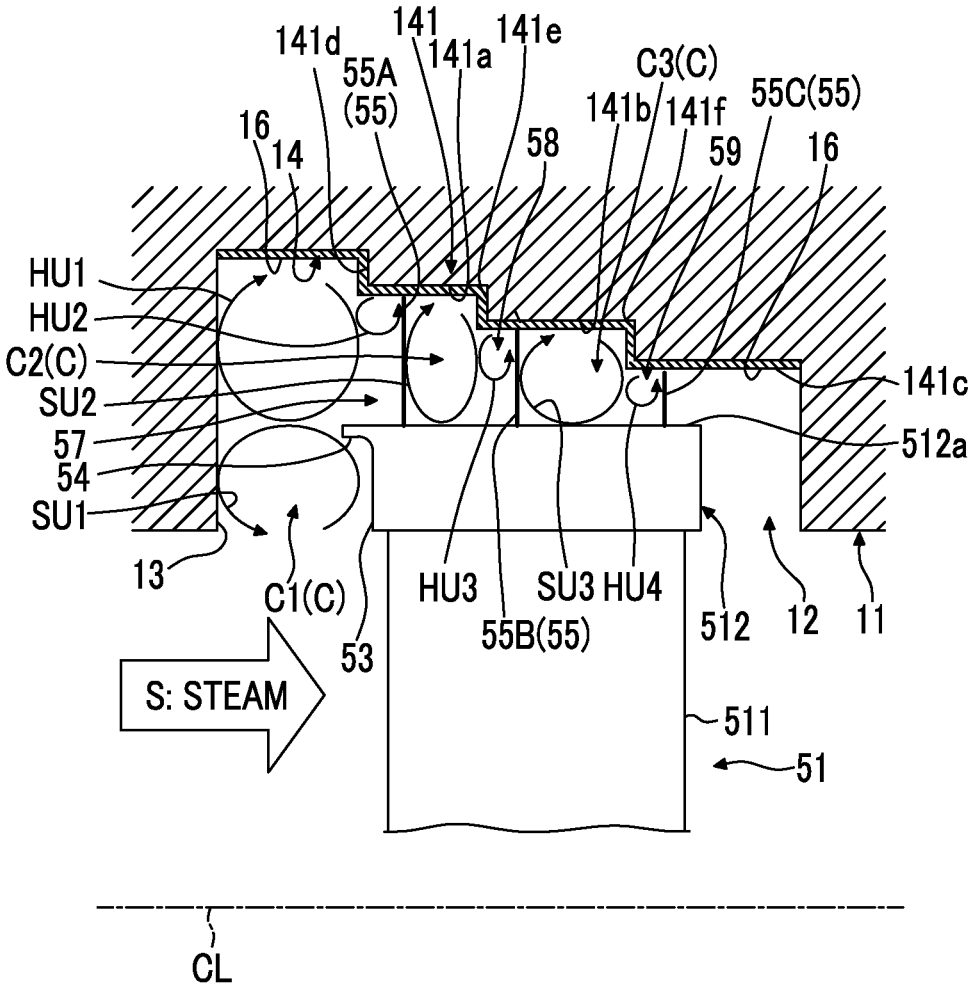
FIG. 4 is a schematic cross-sectional view showing the periphery of a tip portion of a rotor blade related to a second embodiment.

FIG. 4 is a schematic cross-sectional view showing the periphery of the tip portion of the rotor blade 51 related to the second embodiment.

In the present embodiment, a free-cutting material 16 is constructed with a uniform thickness so as to cover the bottom surface 14 of the annular groove 12 formed in the partition plate outer ring 11. The free-cutting material 16 has little sliding friction heat, and is made of materials having more excellent machinability than the sealing fin 55.

As the free-cutting material 16, for example, there are used abradable materials including various kinds of well-known free-cutting materials, such as a cobalt, nickel, chromium, aluminum, and yttrium-based material (CoNiCrAlY-based material), a nickel, chromium, and aluminum-based material (NiCrAl-based material), and a nickel, chromium, iron, aluminum, boron, and nitrogen-based material (NiCrFeAlBN-based material).

In addition, as the free-cutting material 16, a honeycomb layer made of metal, ceramics, or the like can be used the above abradable materials.

In addition, in the present embodiment, the free-cutting material 16 is constructed on the whole bottom surface 14 of the annular groove 12. However, the free-cutting material 16 is sufficient so long as the free-cutting material is constructed at the positions that face the three sealing fins 55 at least in the step portion 141.

Specifically, the free-cutting material may be constructed on the axial wall surface 141*a* that faces the first sealing fin 55A, the axial wall surface 141*b* that faces the second sealing fin 55B, and the axial wall surface 141*c* that faces the third sealing fin 55C.

Additionally, the free-cutting material 16 does not necessarily have uniform thickness over the whole bottom surface 14, and the thickness thereof may change appropriately depending on positions.

Figure 5A:
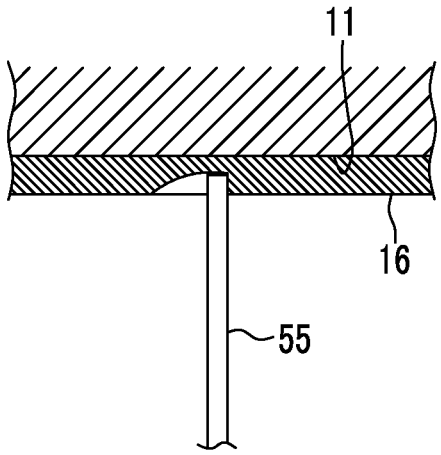
FIG. 5A is a view illustrating the functional effects of a steam turbine related to the second embodiment.
Figure 5B:
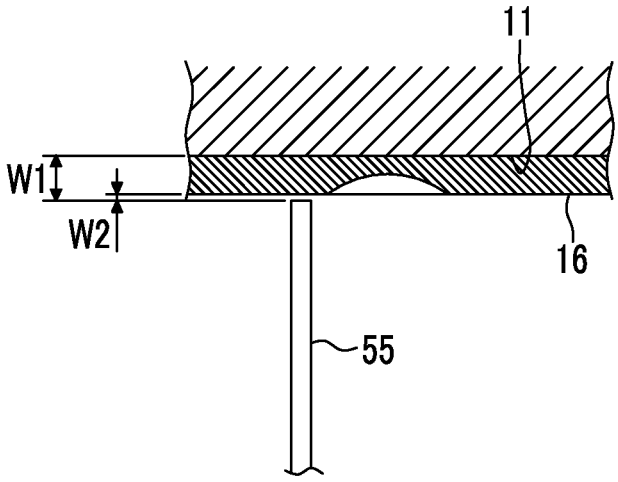
FIG. 5B is a view illustrating the functional effects of the steam turbine related to the second embodiment.

Next, the functional effects of the steam turbine 1 related to the second embodiment will be described focusing on differences from those of the first embodiment. FIGS. 5A and 5B are views illustrating the functional effects of the steam turbine related to the second embodiment.

In the steam turbine 1, heat enters the annular rotor blade group 50 at the time of the starting of the turbine, the thermal elongation of the annular rotor blade group 50 caused by the heat becomes larger than the thermal elongation of the casing 10, and centrifugal elongation is caused in the annular rotor blade group 50, whereby the sealing fins 55 may contact the partition plate outer ring 11.

Accordingly, a radial width W1 (shown in FIG. 5B) with a sufficient size such that the sealing fins 55 and the partition plate outer ring 11 do not contact each other at the time of the starting is set between both the sealing fins and the partition plate outer ring.

In contrast, according to the configuration of the present embodiment, the thermal elongation caused in the annular rotor blade group 50 at the time of the starting of the steam turbine 1 becomes larger than the thermal elongation caused in the casing 10, and centrifugal elongation is caused in the annular rotor blade group 50, whereby as shown in FIG. 5A, the tip portion of the sealing fin 55 cuts the free-cutting material 16. Thereafter, if a predetermined time has passed, the steam turbine 1 shifts to a rated operation.

Then, the thermal elongation of the annular rotor blade group 50 becomes equal to the thermal elongation of the casing 10 or becomes less than the thermal elongation of a casing 10, whereby as shown in FIG. 5B, the sealing fin 55 is brought into a state where the tip portion thereof is separated from the free-cutting material 16. At this time, a radial width W2 between the tip portion of the sealing fin 55 and the free-cutting material 16 is significantly narrow as compared to the radial width W1.

This can reduce the amount of leaking of the steam S in the tip portion of the sealing fin 55.

Third Embodiment

Next, the configuration of a steam turbine related to a third embodiment of the invention will be described.

The steam turbine related to the third embodiment is different from the steam turbine 1 of the first embodiment in the configuration of the partition plate outer ring 11 and the rotor blade 51 that are shown in FIG. 1. Since the other configuration is the same as that of the first embodiment, the same configuration will be designated by the same reference numerals, and the description thereof will be omitted here.

Figure 6:
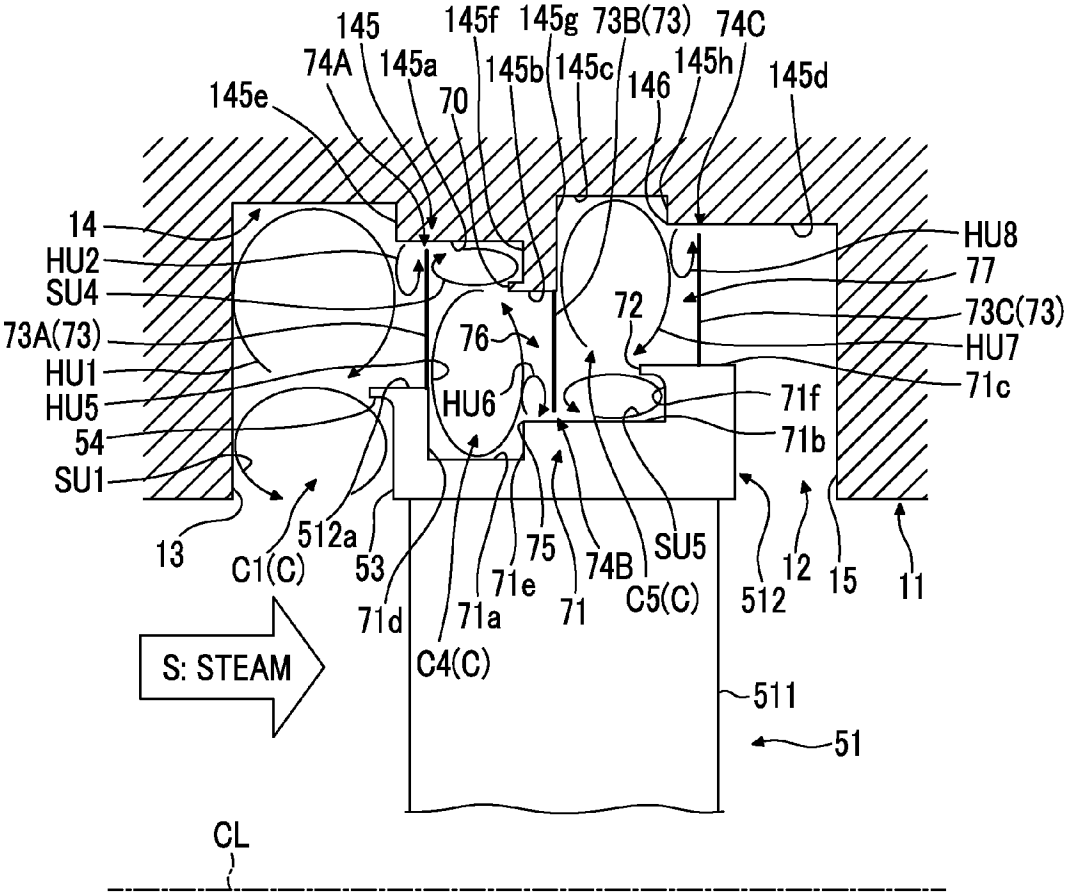
FIG. 6 is a schematic cross-sectional view showing the periphery of a tip portion of a rotor blade related to a third embodiment.

FIG. 6 is a schematic cross-sectional view showing the periphery of the tip portion of the rotor blade 51 related to the third embodiment.

Also in the present embodiment, similar to the first embodiment, the annular groove 12 is formed along the circumferential direction in the inner peripheral surface of the partition plate outer ring 11. The annular groove 12 is formed by the upstream wall surface 13, the bottom surface 14, and the downstream wall surface 15. A stair-shaped step portion 145 is provided at the position of the bottom surface 14 that faces the tip shroud 512.

The step portion 145 includes four steps, and has four axial wall surfaces (inner peripheral surfaces) 145*a*, 145*b*, 145*c*, and 145*d* along the axial direction, and four radial wall surfaces 145*e*, 145*f*, 145*g*, and 145*h* along the radial direction. The radial wall surface 145*f* (flow collision surface) against which the steam S collides is provided with a protrusion 70 that protrudes toward the upstream side.

Meanwhile, as shown in FIG. 6, the tip shroud 512 disposed at the tip portion of the rotor blade 51 is different from the first embodiment in that the outer peripheral surface 512*a* is formed with a stair-shaped step portion 71.

Since the other configuration of the tip shroud 512 is the same as that of the first embodiment, the same configuration will be designated by the same reference numerals, and the description thereof will be omitted here.

The step portion 71 includes three steps, and has three axial wall surfaces (inner peripheral surfaces) 71*a*, 71*b*, and 71*c* along the axial direction, and three radial wall surfaces 71*d*, 71*e*, and 71*f* along the radial direction. The radial wall surface 71*f* (flow collision surface) against which the steam S collides is provided with a protrusion 72 that protrudes toward the upstream side.

In the present embodiment, as shown in FIG. 6, three sealing fins 73 extending in the radial direction are provided at predetermined intervals in the axial direction, respectively.

Among these sealing fins, a first sealing fin 73A located furthest to the upstream side has a base end portion fixed to a position slightly downstream of the radial wall surface 145*e* on the outer peripheral surface 512*a* of the tip shroud 512. The tip portion of the first sealing fin 73A reaches a position close to the axial wall surface 145*a* of the partition plate outer ring 11.

Accordingly, a minute gap 74A is formed between the first sealing fin 73A and the axial wall surface 145*a*.

Additionally, a second sealing fin 73B located secondly further to the upstream side has a base end portion fixed to a position slightly downstream of the radial wall surface 71*e* on the axial wall surface 145*b* of the partition plate outer ring 11. The tip portion of the second sealing fin 73B reaches a position close to the axial wall surface 71*b* of the tip shroud 512.

Accordingly, a minute gap 74B is formed between the second sealing fin 73B and the axial wall surface 71*b*.

Additionally, a third sealing fin 73C located furthest to the downstream side has a base end portion fixed to a position slightly downstream of the radial wall surface 145*h* on the axial wall surface 71*c* of the tip shroud 512. The tip portion of the third sealing fin 73C reaches a position close to the axial wall surface 145*d* of the partition plate outer ring 11.

Accordingly, a minute gap 74C is formed between the third sealing fin 73C and the axial wall surface 145*d*.

In addition, the lengths, shapes, installation positions, number, or the like of the sealing fins 73 is not limited to the present embodiment, and design can be appropriately changed according to the cross-sectional shape or the like of the tip shroud 512 and/or the partition plate outer ring 11.

According to the configuration around the tip portion of such a rotor blade 51, as shown in FIG. 6, three cavities C are formed by the partition plate outer ring 11, the three sealing fins 73, and the tip shroud 512.

Among these cavities, the first cavity C1 located furthest to the upstream side has the same configuration as that of the first embodiment.

Additionally, a fourth cavity C4 located secondly further to the upstream side is formed by the first sealing fin 73A, the bottom surface 14 of the partition plate outer ring 11, the second sealing fin 73B, and the outer peripheral surface 512*a* of the tip shroud 512.

Additionally, a fifth cavity C5 located furthest to the downstream side is formed by the second sealing fin 73B, the bottom surface 14 of the partition plate outer ring 11, the third sealing fin 73C, and the outer peripheral surface 512*a* of the tip shroud 512.

In addition, in the present embodiment, the radial wall surface 145*f* that forms the fourth cavity C4 corresponds to the flow collision surface related to the invention, and similarly, the downstream side surface of the first sealing fin 73A that forms the fourth cavity C4 corresponds to the facing surface related to the invention.

Additionally, the radial wall surface 71*f* that forms the fifth cavity C5 corresponds to the flow collision surface related to the invention, and similarly, the downstream side surface of the second sealing fin 73B that forms the fifth cavity C5 corresponds to the facing surface related to the invention.

Next, the functional effects of the steam turbine 1 related to the third embodiment will be described focusing on differences from those of the first embodiment.

If the steam S that flows in the axial direction collides against the steam collision surface 53 as shown in FIG. 6, similar to the first embodiment, the separation vortex HU1, the separation vortex HU2, and the main vortex SU1 are generated inside the first cavity C1. The separation vortex HU2 exhibits the so-called contraction flow effect of reducing the amount of leaking of the steam S in the minute gap 74A.

Then, the steam S that has leaked from the minute gap 74A flows into the fourth cavity C4. The steam S collides against the radial wall surface 145*f* of the partition plate outer ring 11 to form a clockwise main vortex SU4. As a portion of the main vortex SU4 is separated from the protrusion 70, a counterclockwise separation vortex HU5 is generated. Moreover, as a portion of the separation vortex HU5 is separated from a corner portion 75 of the tip shroud 512, a clockwise separation vortex HU6 is generated in a widened portion 76 of the fourth cavity C4.

The separation vortex HU6 flows from the second sealing fin 73B toward the tip shroud 512 side at the position of the minute gap 74B. Accordingly, the separation vortex HU6 also exhibits the contraction flow effect of reducing the amount of leaking of the steam S in the minute gap 74B.

Moreover, the steam S that has leaked from the minute gap 74B flows into the fifth cavity C5. The steam S collides against the radial wall surface 71*f* of the tip shroud 512 to form a counterclockwise main vortex SU5. As a portion of the main vortex SU5 is separated from the protrusion 72 of the tip shroud 512, a clockwise separation vortex HU7 is generated. Moreover, as a portion of the separation vortex HU7 is separated from a corner portion 146 of the partition plate outer ring 11, a counterclockwise separation vortex HU8 is generated in a widened portion 77 of the fifth cavity C5.

The separation vortex HU8 flows from the third sealing fin 73C toward the partition plate outer ring 11 side at the position of the minute gap 74C. Accordingly, the separation vortex HU8 also exhibits the contraction flow effect of reducing the amount of leaking of the steam S in the minute gap 74C.

In this way, according to the third embodiment, the amount of leaking of the steam S can be reduced in the first cavity C1, the fourth cavity C4, and the fifth cavity C5, respectively, by the contraction flow effect of the separation vortex HU2, the separation vortex HU6, and the separation vortex HU8.

Accordingly, according to the present embodiment, the amount of leaking of the steam S can be suppressed to the minimum more than the first embodiment. In addition, the number of the cavities C along the axial direction is not limited to three, and an arbitrary number of cavities can be provided.

Fourth Embodiment

Next, the configuration of a steam turbine related to a fourth embodiment of the invention will be described.

The steam turbine related to the fourth embodiment is different from that of the first embodiment in that the annular stator blade group 40 shown in FIG. 1 corresponds to the blades related to the invention, and the shaft body 30 corresponds to the structure related to the invention. Since the other configuration is the same as that of the first embodiment, the same configuration will be designated by the same reference numerals, and the description thereof will be omitted here.

Figure 7:
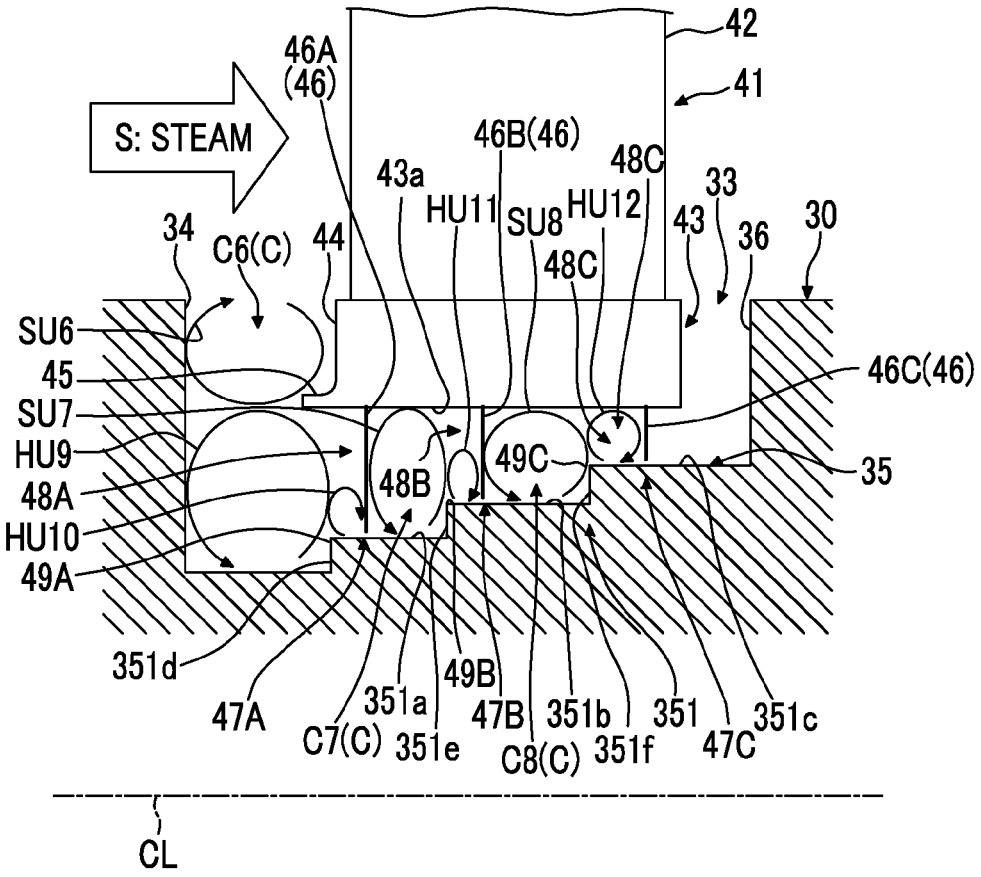
FIG. 7 is a schematic cross-sectional view showing the periphery of a tip portion of a stator blade related to a fourth embodiment.
Figure 8:
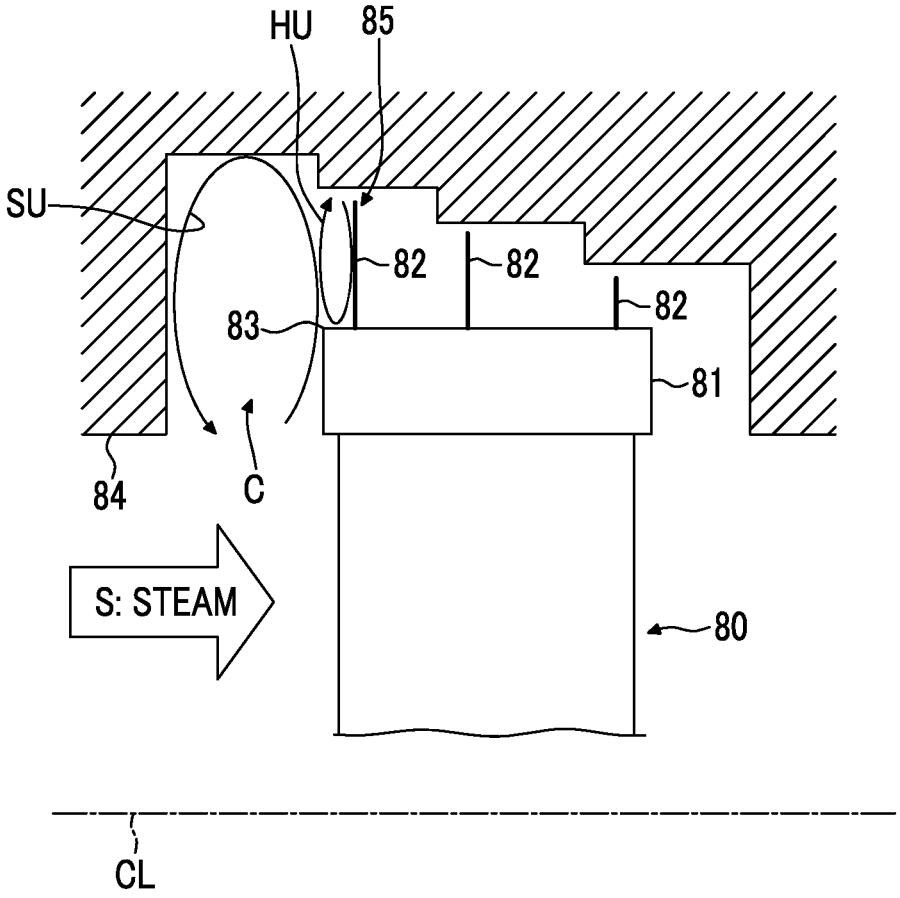
FIG. 8 PRIOR ART
FIG. 8 is a schematic cross-sectional view showing the periphery of a tip portion of a rotor blade regarding a related-art steam turbine.

FIG. 7 is a schematic cross-sectional view showing the periphery of the tip portion of the stator blade 41 related to the fourth embodiment.

An annular groove 33 is formed along the circumferential direction in an outer peripheral surface of the shaft body 30. The annular groove 33 is formed by an upstream wall surface 34 (facing surface), a bottom surface 35, and a downstream wall surface 36. A stair-shaped step portion 351 is provided at the position of the bottom surface 35 that faces the stator blade 41.

The step portion 351 includes three steps that protrude to the stator blade 41 side as it goes to the downstream side, and has three axial wall surfaces (outer peripheral surfaces) 351*a*, 351*b*, and 351*c* along the axial direction, and three radial wall surfaces 351*d*, 351*e*, and 351*f* along the radial direction.

In addition, so long as the step portion 351 has at least the axial wall surface 351*a* and the radial wall surface 351*d*, the number of steps thereof is not limited to the three stages, and can be arbitrarily changed.

Meanwhile, as shown in FIG. 7, the ring-shaped hub shroud 43 is disposed at the tip portion of the stator blade 41 as mentioned above. The hub shroud 43 has a substantially rectangular cross-section, and a steam collision surface 44 (flow collision surface) against which the steam S collides is provided at the position of the hub shroud that faces the upstream wall surface 34 of the shaft body 30.

A radial tip portion of the steam collision surface 44 is provided with a protrusion 45 that protrudes toward the upstream side. The protrusion 45 has a substantially rectangular cross-section, and is provided at the radial tip portion of the hub shroud 43.

In addition, the cross-sectional shape of the protrusion 45 is not limited to the rectangular shape of the present embodiment, and can be arbitrarily changed in design, for example, the cross-sectional shape can also be a triangular shape or a semicircular shape. Additionally, the cross-sectional shape of the hub shroud 43 is not limited to the present embodiment, for example, the cross-sectional shape may be a stair shape of which the thickness in the radial direction becomes smaller as it goes to the downstream side.

Additionally, the position where the protrusion 45 is formed is not limited to the radial tip portion in the steam collision surface 44 of the hub shroud 43, for example, the position may be a radial middle portion or a radial base end portion.

Additionally, the protrusion 45 may be constituted as a so-called axial sealing fin by making a tip of the protrusion 45 protrude to a position close to the upstream wall surface 34 so as to form a minute gap between the protrusion 45 and the upstream wall surface 34.

As shown in FIG. 7, three sealing fins 46 are provided at predetermined intervals in the axial direction on an inner peripheral surface 43*a* of the hub shroud 43 so as to protrude in the radial direction, respectively.

Among these fins, a first sealing fin 46A located furthest to the upstream side has a base end portion fixed to a position slightly downstream of the radial wall surface 351*d*, and reaches a position where a tip portion thereof approaches the axial wall surface 351*a*. Accordingly, a minute gap 47A is formed between the first sealing fin 46A and the axial wall surface 351*a*.

Additionally, a second sealing fin 46B located secondly further toward the upstream side has a base end portion fixed to a position slightly downstream of the radial wall surface 351*e*, and reaches a position where a tip portion thereof approaches the axial wall surface 351*b*. Accordingly, a minute gap 47B is formed between the second sealing fin 46B and the axial wall surface 351*b*.

Additionally, a third sealing fin 46C located furthest toward the downstream side has a base end portion fixed to a position slightly downstream of the radial wall surface 351*f*, and reaches a position where a tip portion thereof approaches the axial wall surface 351*c*. Accordingly, a minute gap 47C is formed between the third sealing fin 46C and the axial wall surface 351*c*.

The lengths of the sealing fins 46 configured in this way become gradually shorter in order of the first sealing fin 46A, the second sealing fin 46B, and the third sealing fin 46C.

In addition, the lengths, shapes, installation positions, number, or the like of the sealing fins 46 is not limited to the present embodiment, and design can be appropriately changed according to the cross-sectional shape or the like of the hub shroud 43 and/or the shaft body 30.

According to the configuration around the tip portion of such a stator blade 41, as shown in FIG. 7, three cavities C are formed by the shaft body 30, the three sealing fins 46, and the hub shroud 43.

Among these cavities, a sixth cavity C6 located furthest to the upstream side is formed by the upstream wall surface 34 of the shaft body 30, similarly the bottom surface 35 of the shaft body 30, the first sealing fin 46A, and the steam collision surface 44 of the hub shroud 43.

Additionally, a seventh cavity C7 located secondly further to the upstream side is formed by the first sealing fin 46A, the bottom surface 35 of the shaft body 30, the second sealing fin 46B, and the inner peripheral surface 43*a* of the hub shroud 43.

Additionally, an eighth cavity C8 located furthest to the downstream side is formed by the second sealing fin 46B, the bottom surface 35 of the shaft body 30, the third sealing fin 46C, and the inner peripheral surface 43*a* of the hub shroud 43.

Here, as shown in FIG. 7, the sixth cavity C6 has a substantially rectangular shape in a cross-section taken along the axial direction. However, the first sealing fin 46A is fixed to a position slightly downstream of the radial wall surface 351*d* as mentioned above. Accordingly, a widened portion 48A that is slightly widened in the axial direction is formed at an axial downstream portion of the sixth cavity C6.

Additionally, as shown in FIG. 7, the seventh cavity C7 has a substantially rectangular shape in a cross-section taken along the axial direction. However, the second sealing fin 46B is fixed to a position slightly downstream of the radial wall surface 351*e* as mentioned above. Accordingly, a widened portion 48B that is slightly widened in the axial direction is formed also at an axial downstream portion of the seventh cavity C7.

Moreover, the eighth cavity C8 also has a substantially rectangular shape in a cross-section taken along the axial direction. However, the third sealing fin 46C is fixed to a position slightly downstream of the radial wall surface 351*f* as mentioned above. Accordingly, a widened portion 48C that is slightly widened in the axial direction is formed also at an axial downstream portion of the eighth cavity C8.

Next, the functional effects of the steam turbine 1 related to the fourth embodiment will be described with reference to FIG. 7.

A portion of the steam S, which flows in the axial direction, collides against the steam collision surface 44 of the hub shroud 43. Then, a clockwise main vortex SU6 in FIG. 7 is generated in a region located further toward a blade base end side than the protrusion 45 inside the sixth cavity C6. As a portion of the main vortex SU6 is separated from the protrusion 45, a separation vortex HU9 is generated in a region located further toward a blade tip end side than the protrusion 45 inside the sixth cavity C6. The rotational direction of the separation vortex HU9 is a direction reverse to that of the main vortex SU6, that is, a counterclockwise direction in FIG. 7.

As a portion of the separation vortex HU9 is further separated from a corner portion 49A of the shaft body 30, a separation vortex HU10 is generated in the widened portion 48A of the sixth cavity C6. The rotational direction of the separation vortex HU10 is a direction reverse to the separation vortex HU9, that is, in a clockwise direction in FIG. 7, and flows from the first sealing fin 46A toward the shaft body 30 side at the position of the minute gap 47A.

Accordingly, the separation vortex HU10 exhibits the so-called contraction flow effect of reducing the amount of leaking of the steam S in the minute gap 47A.

Then, the steam S that has leaked from the minute gap 47A flows into the seventh cavity C7. The steam S collides against the radial wall surface 351*e* of the shaft body 30 to form a counterclockwise main vortex SU7.

As a portion of the main vortex SU7 is separated from a corner portion 49B of the shaft body 30, a clockwise separation vortex HU11 is generated in the widened portion 48B of the seventh cavity C7. The separation vortex HU11 flows from the second sealing fin 46B toward the shaft body 30 side at the position of the minute gap 47B.

Accordingly, the separation vortex HU11 also exhibits the contraction flow effect of reducing the amount of leaking of the steam S in the minute gap 47B.

Moreover, the steam S that has leaked from the minute gap 47B flows into the eighth cavity C8. The steam S collides against the radial wall surface 351*f* of the shaft body 30 to form a counterclockwise main vortex SU8.

As a portion of the main vortex SU8 is separated from a corner portion 490 of the shaft body 30, a clockwise separation vortex HU12 is generated in the widened portion 48C of the eighth cavity C8. The separation vortex HU12 flows from the third sealing fin 46C toward the shaft body 30 side at the position of the minute gap 47C.

Accordingly, the separation vortex HU12 also exhibits the contraction flow effect of reducing the amount of leaking of the steam S in the minute gap 47C.

In this way, the amount of leaking of steam S can be suppressed to the minimum by reducing the amount of leaking of the steam S in the sixth cavity C6, the seventh cavity C7, and the eighth cavity C8, respectively, by the contraction flow effect of the separation vortex HU10, the separation vortex HU11, and the separation vortex HU12.

In addition, the number of the cavities C along the axial direction is not limited to three, and an arbitrary number of cavities can be provided.

In addition, the various shapes or combinations, of the respective constituent members that are shown in the above-described embodiments, the operation procedures, and the like are examples, and can be variously changed on the basis of design requirements or the like without departing from the spirit of the invention.

For example, in the above embodiments, the annular groove 12 and the step portion 141 or 145 are formed in the partition plate outer ring 11. However, the partition plate outer ring 11 is not a constituent indispensable to the invention, and the annular groove 12 and the step portion 141 or 145 may be formed in the casing 10 without providing the partition plate outer ring 11.

Additionally, in the above embodiments, the invention is applied to a condensate-type steam turbine. However, the invention can also be applied to other types of steam turbine, for example, a two-stage bleeder turbine, a bleeder turbine, an air-mixing turbine, and the like.

Moreover, in the above embodiments, the invention is applied to the steam turbine. However, the invention can also be applied to a gas turbine, and the invention can be applied to all apparatuses having a rotary blade.

INDUSTRIAL APPLICABILITY

The invention relates to a turbine including blades and a structure provided on a radial tip end side of the blades via a gap and rotating relative to the blade, and having a fluid flowing to the gap. The turbine includes step portions that are provided in either radial tip portions of the blades or areas of the structure that face the radial tip portions, and have steps in a radial direction; sealing fins that extend from the other of the radial tip portions of the blades and the areas of the structure that face the radial tip portions, toward the step portions, and forms minute gaps between the sealing fins and the step portions; a flow collision surface that is provided upstream of the sealing fins in a flow direction of the fluid and against which the fluid collides; a protrusion that protrudes toward an upstream side from the flow collision surface; and a facing surface that faces the flow collision surface. According to the invention, in a turbine in which the sealing fins extend from either the blades or the structure toward the other, the amount of leaking of the steam in the gaps between the tips of the sealing fins and the blades or the structure can be reduced.

REFERENCE SIGNS LIST

1: STEAM TURBINE
10: CASING
11: PARTITION PLATE OUTER RING
12: ANNULAR GROOVE
13: UPSTREAM WALL SURFACE
14: BOTTOM SURFACE
141: STEP PORTION
141*a*, 141*b*, 141*c*: AXIAL WALL SURFACE
141*d*, 141*e*, 141*f*: RADIAL WALL SURFACE
142 TO 144, 146: CORNER PORTION
145: STEP PORTION
145*a*, 145*b*, 145*c*, 145*d*: AXIAL WALL SURFACE
145*e*, 145*f*, 145*g*, 145*h*: RADIAL WALL SURFACE
15: DOWNSTREAM WALL SURFACE
16: FREE-CUTTING MATERIAL
20: ADJUSTING VALVE
21: ADJUSTING VALVE CHAMBER
22: VALVE BODY
23: VALVE SEAT
24: STEAM CHAMBER
30: SHAFT BODY
31: MAIN SHAFT BODY

32: DISK
33: ANNULAR GROOVE
34: UPSTREAM WALL SURFACE
35: BOTTOM SURFACE
351: STEP PORTION
351*a*, 351*b*, 351*c*: AXIAL WALL SURFACE
351*d*, 351*e*, 351*f*: RADIAL WALL SURFACE
36: DOWNSTREAM WALL SURFACE
40: ANNULAR STATOR BLADE GROUP
41: STATOR BLADE
42: BLADE BODY
43: HUB SHROUD
43*a*: INNER PERIPHERAL SURFACE
44: STEAM COLLISION SURFACE
45: PROTRUSION
46: SEALING FIN
46A: FIRST SEALING FIN
46B: SECOND SEALING FIN
46C: THIRD SEALING FIN
47A TO 47C: MINUTE GAP
48A TO 48C: WIDENED PORTION
49A TO 49C: CORNER PORTION
50: ANNULAR ROTOR BLADE GROUP
51: ROTOR BLADE
511 BLADE BODY
512 TIP SHROUD
512*a*: OUTER PERIPHERAL SURFACE
53: STEAM COLLISION SURFACE
54 PROTRUSION
55: SEALING FIN
55A: FIRST SEALING FIN
55B: SECOND SEALING FIN
55C: THIRD SEALING FIN
56A TO 56C: MINUTE GAP
57 TO 59: WIDENED PORTION
60: BEARING SECTION
61: JOURNAL BEARING DEVICE
62: THRUST BEARING DEVICE
70: PROTRUSION
71: STEP PORTION
71*a*, 71*b*, 71*c*: AXIAL WALL SURFACE
71*d*, 71*e*, 71*f*: RADIAL WALL SURFACE
72: PROTRUSION
73 SEALING FIN
73A: FIRST SEALING FIN
73B: SECOND SEALING FIN
73C: THIRD SEALING FIN
74A TO 74C: MINUTE GAP
75 TO 77: CORNER PORTION
C: CAVITY
C1: FIRST CAVITY
C2: SECOND CAVITY
C3: THIRD CAVITY
C4: FOURTH CAVITY
C5: FIFTH CAVITY
C6: SIXTH CAVITY
C7: SEVENTH CAVITY
C8: EIGHTH CAVITY
HU1 TO HU12: SEPARATION VORTEX
S: STEAM
SU1 TO SU8: MAIN VORTEX
W1: RADIAL WIDTH
W2: RADIAL WIDTH

The invention claimed is:

1. A turbine including a blade and a structure on a radial tip end side of the blade via a gap and rotatable relative to the blade, the turbine being configured such that a fluid flows to the gap, and the turbine comprising:

a step portion that is in either a radial tip portion of the blade or an area of the structure that faces the radial tip portion, and has a plurality of steps in a radial direction;

a plurality of sealing fins that extends from the other of the radial tip portion of the blade and the area of the structure that faces the radial tip portion, toward the step portion, and defines a minute gap between each of the plurality of sealing fins and the step portion;

a flow collision surface that is on the blade and upstream of the plurality of sealing fins in a flow direction of the fluid and against which the fluid is to collide during use of the turbine;

a protrusion that protrudes axially away from a portion of the flow collision surface which is located closest to the structure in the radial direction; and a facing surface that faces the flow collision surface, wherein:

each of the plurality of steps of the step portion has an axial wall surface extending along an axial direction, and a radial wall surface which is connected to the axial wall surface via a corner portion and extends along the radial direction, the plurality of sealing fins is arranged at intervals in the axial direction such that each of the plurality of sealing fins faces a corresponding one of the plurality of steps of the step portion, each of the plurality of sealing fins is fixed at a position downstream of the radial wall surface of the corresponding one of the plurality of steps of the step portion, the protrusion is configured to divide a cavity into a first space which is closer to the structure and a second space which is closer to a body of the blade, the cavity being defined by one of the plurality of sealing fins which is furthest upstream, the flow collision surface, the structure, and the facing surface, and the protrusion protrudes further axially away from the flow collision surface than the radial wall surface of one of the plurality of steps which is furthest upstream.

2. The turbine according to claim 1, wherein a free-cutting material having greater machinability than each of the plurality of sealing fins is on a surface of each of the plurality of steps of the step portion.

3. The turbine according to claim 1, wherein the step portion is at the structure, and the plurality of sealing fins is at the blade.

4. The turbine according to claim 1, wherein the structure is a casing that holds a shaft body that is rotationally driven, and wherein the blade is a rotor blade that is fixed to the shaft body and extends to a casing side.

5. The turbine according to claim 1, wherein the structure is a shaft body that is rotationally driven, and wherein the blade is a stator blade that is fixed to a casing holding the shaft body and extends to a shaft body side.

6. The turbine according to claim 1, wherein the plurality of sealing fins is arranged such that respective lengths of each of the plurality of sealing fins become shorter in order from in the flow direction of the fluid.

7. The turbine according to claim 1, wherein the radial tip portion of the blade has a substantially rectangular cross section.

* * * * *